US009764246B2

(12) United States Patent
Fox

(10) Patent No.: US 9,764,246 B2
(45) Date of Patent: Sep. 19, 2017

(54) ROTATING PERFORMANCE STAGE

(71) Applicant: DreamLight Holdings Inc., Beverly Hills, CA (US)

(72) Inventor: Steve Fox, Los Angeles, CA (US)

(73) Assignee: DREAMLIGHT HOLDINGS INC., Beverly Hills, CA (US)

( * ) Notice: Subject to any disclaimer, the term of this patent is extended or adjusted under 35 U.S.C. 154(b) by 0 days.

(21) Appl. No.: 14/605,050

(22) Filed: Jan. 26, 2015

(65) Prior Publication Data

US 2015/0141162 A1 May 21, 2015

Related U.S. Application Data

(62) Division of application No. 14/183,077, filed on Feb. 18, 2014, now abandoned.

(60) Provisional application No. 61/766,567, filed on Feb. 19, 2013.

(51) Int. Cl.

| | |
|---|---|
| ***E04H 3/22*** | (2006.01) |
| ***E04H 3/26*** | (2006.01) |
| ***A63J 5/00*** | (2006.01) |
| ***A63G 31/16*** | (2006.01) |
| ***A63G 31/02*** | (2006.01) |

(52) U.S. Cl.

CPC ..... *A63G 31/02* (2013.01); *E04H 3/22* (2013.01); *E04H 3/26* (2013.01); *A63J 2005/002* (2013.01)

(58) Field of Classification Search

CPC ..... E04H 3/22; E04H 3/26; A63J 2005/002; A63G 31/16

USPC ..... 52/1, 7, 8, 9, 10; 472/57, 59, 75, 76

See application file for complete search history.

(56) References Cited

U.S. PATENT DOCUMENTS

| | | | | |
|---|---|---|---|---|
| 748,116 A | | 12/1903 | Stoll | |
| 1,499,672 A | * | 7/1924 | Lezert | A63G 1/06 180/2.1 |
| 1,635,108 A | * | 7/1927 | Bluthardt | A63G 1/30 472/12 |
| 1,819,656 A | * | 8/1931 | Pressley | A63J 1/00 108/139 |
| 1,868,068 A | | 7/1932 | Moulten | |
| 1,893,167 A | | 1/1933 | Glagolin | |
| 3,112,929 A | | 12/1963 | Gisser | |
| 4,136,935 A | | 1/1979 | Cook et al. | |
| 5,326,266 A | | 7/1994 | Fisher et al. | |

(Continued)

FOREIGN PATENT DOCUMENTS

| | | | | |
|---|---|---|---|---|
| CA | 2285822 A1 | * | 3/2001 | G03H 1/22 |
| DE | 1020040 18 885 | | 11/2004 | |

(Continued)

OTHER PUBLICATIONS

International Search Report and Written Opinion for PCT/US2014/016943, mailed May 27, 2014.

(Continued)

*Primary Examiner* — Brian Glessner
*Assistant Examiner* — Omar Hijaz
(74) *Attorney, Agent, or Firm* — Foley & Lardner LLP

(57) ABSTRACT

A theater area includes audience seating that faces outwardly in an "inverted-theater-in-the-round" arrangement towards a ring-shaped performance stage. The performance stage is designed to rotate around the audience area so that each section of the audience can see each part of the stage at different times.

9 Claims, 8 Drawing Sheets

(56) References Cited

U.S. PATENT DOCUMENTS

| | | | | |
|---|---|---|---|---|
| 5,376,980 | A | 12/1994 | Gersuk et al. | |
| 5,577,350 | A | 11/1996 | Brisbin et al. | |
| 5,765,314 | A | 6/1998 | Giglio et al. | |
| 5,790,124 | A | 8/1998 | Fischer et al. | |
| 5,833,544 | A | 11/1998 | Corbin et al. | |
| 5,964,064 | A | 10/1999 | Goddard et al. | |
| 6,017,276 | A | 1/2000 | Elson et al. | |
| 6,151,081 | A | 11/2000 | Gold et al. | |
| 6,237,290 | B1 | 5/2001 | Tokimoto et al. | |
| 6,253,494 | B1 | 7/2001 | Shaffron | |
| 6,407,798 | B2 | 6/2002 | Graves et al. | |
| 6,409,599 | B1 * | 6/2002 | Sprout | A63F 13/08 463/31 |
| 6,578,971 | B1 | 6/2003 | Neff | |
| 6,593,957 | B1 | 7/2003 | Christie | |
| 6,727,971 | B2 | 4/2004 | Lucas | |
| 6,733,136 | B2 | 5/2004 | Lantz et al. | |
| 6,745,699 | B2 * | 6/2004 | Hill | B62D 65/18 104/35 |
| 6,848,219 | B2 | 2/2005 | Standard et al. | |
| 6,909,543 | B2 | 6/2005 | Lantz | |
| 6,937,295 | B2 | 8/2005 | Islam et al. | |
| 6,939,236 | B2 | 9/2005 | McLaren et al. | |
| 7,545,108 | B2 | 6/2009 | Flessas | |
| 7,665,685 | B2 * | 2/2010 | Moore, III | B65H 49/28 138/106 |
| 7,791,799 | B1 | 9/2010 | Lejeune et al. | |
| 8,012,023 | B2 | 9/2011 | Gates et al. | |
| 8,054,547 | B2 | 11/2011 | Anderson et al. | |
| 8,194,315 | B2 | 6/2012 | Sharp et al. | |
| 8,206,230 | B2 | 6/2012 | Magpuri | |
| 2003/0145760 | A1 * | 8/2003 | Hadley | E04H 6/44 105/28 |
| 2004/0183656 | A1 | 9/2004 | Abel et al. | |
| 2007/0193123 | A1 * | 8/2007 | Magpuri | E04H 3/22 52/8 |
| 2008/0186415 | A1 | 8/2008 | Boud et al. | |
| 2009/0126596 | A1 | 5/2009 | Threlkel | |
| 2010/0073468 | A1 | 3/2010 | Kutner | |
| 2010/0123880 | A1 | 5/2010 | Oren | |
| 2010/0139176 | A1 * | 6/2010 | Flueck | E04H 3/10 52/9 |
| 2011/0058113 | A1 | 3/2011 | Threlkel et al. | |
| 2011/0170074 | A1 * | 7/2011 | Ferren | G03B 21/56 353/94 |
| 2011/0219632 | A1 | 9/2011 | Odom | |
| 2012/0052961 | A1 | 3/2012 | Crawford et al. | |
| 2012/0224311 | A1 | 9/2012 | Sutherland et al. | |
| 2012/0247030 | A1 | 10/2012 | Magpuri | |
| 2012/0260785 | A1 * | 10/2012 | Carrier | B23D 47/08 83/62.1 |
| 2012/0297695 | A1 * | 11/2012 | Magpuri | E04H 3/22 52/9 |
| 2013/0327913 | A1 * | 12/2013 | Fruhm | A63J 1/00 248/349.1 |

FOREIGN PATENT DOCUMENTS

| | | |
|---|---|---|
| EP | 1 916 845 | 4/2008 |
| EP | 2 061 261 | 5/2009 |

OTHER PUBLICATIONS

Non-Final Office Action on U.S. Appl. No. 14/183,077, mailed Jul. 29, 2014.

International Preliminary Report on Patentability for PCT/US2014/016943, mailed Aug. 25, 2015.

* cited by examiner

ROTATING PERFORMANCE STAGE

CROSS-REFERENCE TO RELATED APPLICATIONS

This application is a Divisional of U.S. application Ser. No. 14/183,077, filed Feb. 18, 2014, which claims the benefit of priority to U.S. Provisional Application No. 61/766,567, filed Feb. 19, 2013, the entire contents of which are incorporated by reference herein and for all purposes.

SUMMARY OF THE DISCLOSURE

Described herein is a performance stage that encircles an audience area. The performance stage includes a ring-shaped performance platform. The performance stage includes a structure supporting the platform. Between the platform and the support structure, the stage includes a movement mechanism, (e.g., including rollers and timed automation), which is designed to move the performance platform in a circular movement pattern across the support.

In another embodiment, an example theater area includes an outward-facing audience area and a performance stage encircling the audience area. In the example theater, the audience area may be supported on audience platforms and may be able to rotate around inside the performance stage.

In another embodiment, an example method for using a ring-shaped performance stage surrounding an audience area involves positioning performance elements (e.g., performers, scenes, etc.) around the stage in a way that allows different parts of the audience to see different performance elements. The method also involves rotating the stage (or the downstage half of the stage) around the audience area so that each performance element is sequentially viewable and non-viewable to each section of the audience.

The foregoing is a summary and thus by necessity contains simplifications, generalizations and omissions of detail. Consequently, those skilled in the art will appreciate that the summary is illustrative only and is not intended to be limiting. Other aspects, inventive features, and advantages of the various elements, devices, and/or processes described herein will become apparent in the detailed description set forth herein and taken in conjunction with the accompanying drawings.

DETAILED DESCRIPTION

Referring generally to the figures, a performance stage for an entertainment venue is described herein along with systems and methods for use in implementations of the described stage. In an exemplary embodiment, the venue may include a contiguous immersive display screen (IDS) occupying substantially the entire visible surface area of the theater which encases the audience (Standing Room and seating areas for GA and VIP guests), and separate display screens for presenting video or graphics to an audience. The venue may be designed such that the stage(s) and screens are positioned around the outside of an audience area. Because the stage/screens may encircle the audience, this arrangement may be considered an inversion of the "theater-in-the-round" design (in which the audience surrounds a stage). In an exemplary embodiment, the entirety of the stage may be movable around the audience, and/or the entirety or portions of the seated audience area may be movable within the area circumscribed by the stage, so that different sections of the audience (or guests) are provided with different views of the performers, from different angles at different times. Additionally, some screens or display surfaces may be moveable around the audience. In some architectures, a toroidal screen may enclose the audience area, providing an IDS. By combining live and displayed presentations, the venue may provide an immersive guest experience, among other advantages. The combination of live performance areas, open audience areas, and immersive screens also provides a venue that can be suited to diverse forms of entertainment. Many other features and advantages of the performance stage will be described in the following sections.

The following description is divided into three sections: (1) Example Environment for a Stage, (2) Stage Design and Implementation, and (3) Modes of Use. The environment section describes the physical design and layout of an example venue and theater within the venue that may house the performance stage. The stage design section describes some of the systems, techniques, and devices that are used to facilitate the stage's functions. The modes of use section describes a few of the novel ways that an exemplary stage may be used. Additional information and disclosure regarding the venue, audio, and display technology that may be used in combination with the embodiments disclosed herein may be found in copending U.S. application Ser. No. 14/183,231 (entitled "Entertainment Venue And Associated Systems/Methods"), U.S. application Ser. No. 14/183,208 (entitled "Immersive Sound System"), and U.S. application Ser. No. 14/183,162 (entitled "Compositing Screen"), which are incorporated herein by reference.

Environment for the Stage

Figure 1:
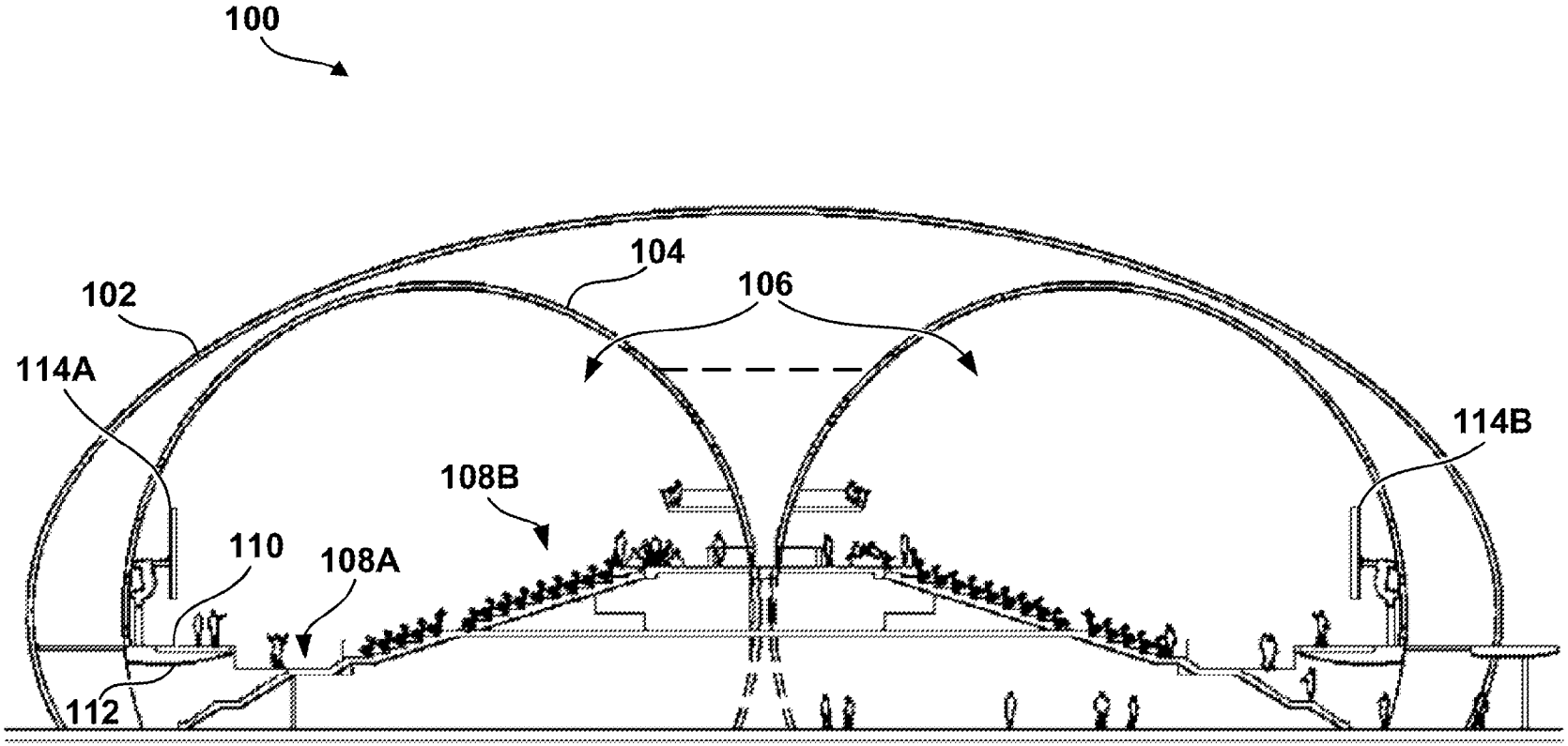
FIG. 1 is a layout design of a theater embodiment that uses an example performance stage.

FIG. 1 shows one embodiment of an entertainment venue 100. As shown, venue 100 includes a dome-shaped exterior 102 over a torus-shaped interior structure 104 that encloses a theater area 106. Theater area 106 includes various levels of audience standing 108A and seating 108B, a stage 110 with supporting structure 112, multiple robotic screens 114A and 114B, and one circular, contiguous crow's nest 116. Although two secondary screens are shown in FIG. 1, any other number of screens may be used. In one embodiment, for example, as many as twenty-four additional robotic screens may be used.

Since the interior structure 104 and enclosed theater area 106 are toroidal in shape, FIG. 1 shows theater area 106 (along with corresponding portions of standing 108A, seating 108B, stage 110, and supports 112) in two segments. In an example embodiment, the arrangement of interior structure 104, theater area 106, standing 108A, seating 108B, and stage 110 may continue around the circumference of the toroidal shape, with secondary screens placed at intervals around the stage (e.g., up to 12 different robotic screens).

The robotic screens can either be attached to the base of the stage or moved independent of the stage on their own track or tracks, which may be attached to the internal shell structure or attached to the rear (upstage) portion of the stage. As will be described in the following sections, various alternative embodiments may include fewer, additional, or different elements than the arrangement shown in FIG. 1.

Among other advantages, the venue design supports many different uses and combinations of events without requiring extensive preparations. For example, the same theater area may present a live lecture in the afternoon, show a movie in the evening, or a live concert performance, and then transform into a nightclub after-hours, without the need for significant "change over" between events. As another example, the venue may be used for a combination of events, such as a nightclub with a stage or DJ show, a movie that is complimented with a live concert (or pre-recorded concert), and/or another live stage performance or performances. Additionally, the inverted-theatre-in-the-round seating arrangement, and the close proximity of the audience to the stage (versus a conventional stage/seating arrangement), creates a more intimate, engaging, one-on-one experience.

I. Exterior Enclosure

One embodiment of an external enclosure is a "dome" shaped shell enclosing the indoor toroidal enclosure and various theater features of the entertainment venue. FIG. 1 shows such an implementation, in which the exterior shell is in the shape of an ellipsoid. Other example embodiments could include spherical, hemispherical, rectangular, cubic, pyramid shaped, toroidal, conical, or other shape of exterior enclosures. In some cases, the implementation of the shell exterior may be supported separately from the display screen to handle various loads, such as wind loads that will not be a requirement for the internal enclosure. In other implementations, the display screen and exterior may be supported by connected rigging to the interior structure, as a function of load support or stationary support. Structural supports for the exterior ellipsoid or internal torus, the display screen, rear screens (if applicable), speakers, lighting, A/C, heat, ducting, rigging and more may include various internal framing components, framing support and/or external superstructural components.

Although FIG. 1 shows enclosure 102 housing a single theater area 106, an example entertainment venue may include multiple theater areas (e.g., multiple viewing areas with similar or different content, within the single theater). Each respective theater area, if separated, may include its own display screens, performance stages, and/or other features to facilitate all entertainment activities.

II. Audience Area

An audience area may be provided inside any of the theater areas. As shown in FIG. 1, the audience area may include a standing room area (SRO) 108A and various seating areas 108B for audience members of both General Audience (GA) or (VIP) areas. The audience area may also include open spaces or non-obstructed spaces to be used interchangeably in accordance with particular entertainment events. For example, open areas may be used as dance floors, orchestra pits, security zones, theatrical displays, non-permanent seating additional stage areas (such as trusses, jets), additional lighting or sound rigs, pyrotechnic or lighting displays, smoke, smog, live actors or stage performers, among other examples. In some embodiments, the entire audience area may rotate either in lieu of, or in combination with, the actual stage rotating. In another embodiment, select audience areas may contain motion seats.

In an exemplary embodiment, the audience seating 108B may face outward from a central area of the theater. In some embodiments, each seat may be oriented in a direction facing away from a central point. In other embodiments, rows of seats may face substantially outward although each individual seat may not face directly outward. In still other embodiments, seat direction may be changeable, movable or interchangeable, or entire sections may be changeable, movable, or interchangeable. For example, seats may be able to rotate, or have some degree of motion (a third sensory element—movement).

Seats with changeable orientation may freely rotate, allowing the audience to turn their own seats during an event, or the orientation of the seats may be changeable by technology or programming to facilitate different events. For instance, to prepare for a show in which the action takes place on a central active area of the stage, seats may face or move to the active area of the stage, or mirror the actions of the content, live performance or other rather than move in one specific direction. In some implementations, the entire platform, or partial sections of the platform, upon which the seats rest could move.

Although many example embodiments in the disclosure present a theater area in which a circular stage surrounds an outward-facing audience, a theater of the present invention can alternatively be configured to have the audience face inward towards a circular center stage. The seating, comprised of concentric rings, can be made to face inward, and rake up from the center, by lowering the center rings on which the circular rows of seating reside, and raising the outer rings. In the fashion, the venue can be easily and quickly converted to accommodate either seating configuration. These moving concentric rings (each of which is flat, and may house one or more rows of seating) can also be rotated, and moved up and down in synchronization with the projected imagery to enhance the audience experience with engagement of a third sense (motion), in addition to sight and sound.

Figure 1B:
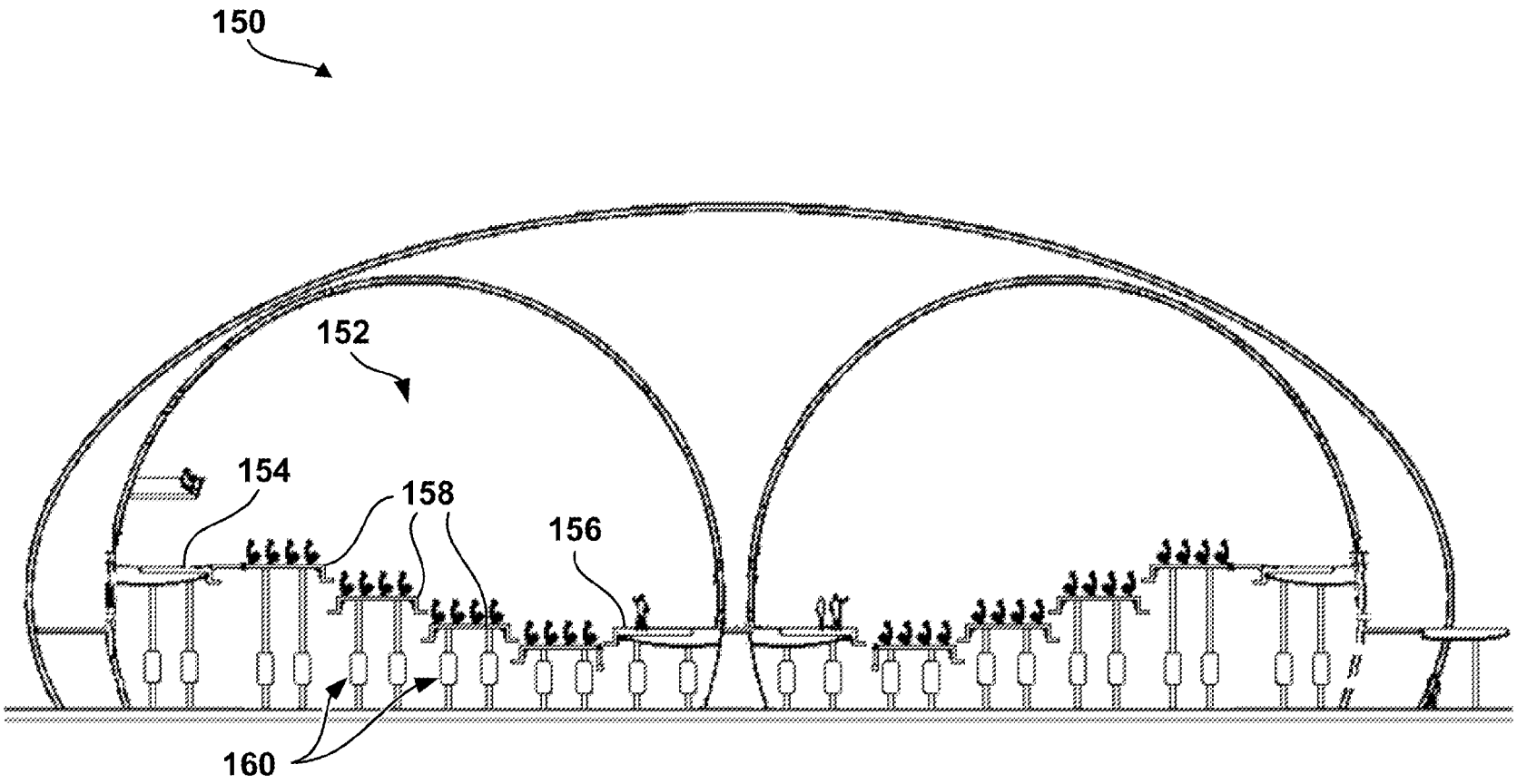
FIG. 1B is a layout design of an exemplary venue with moveable seating.

FIG. 1B shows an example venue arrangement including such movable seating areas. As shown in FIG. 1B, a venue 150 may include a theater area 152 including two stages 154 (outside stage) and 156 (inside stage). In other embodiments, a single stage may be used at one time. Also as shown in FIG. 1B, the audience-seating platform 158 (or multiple platforms) may be mounted on movable supports 160. Such supports may include lifting/lowering mechanisms to control the height of individual sections of the seating. In this way, the seating may change from raking outward to raking inward in order to present different types of performance/visual presentations.

The audience seating may include any or all of four main sections: i) a GA (general admission) in which the audience stands (this may encircle the seated audience members and make them feel immersed in party environment); ii) a seated section configured with inverted (i.e., convex) banquette style seating (without armrests or separation between seats. These seats may face seatbacks of the row in front of them with a recessed bar/counter for drinks, food, etc., creating a lounge environment; iii) chaise style reclined couches and seating, surrounded on three sides with 3 foot high open and closable fabric walls, such that when reclined, the audience member(s) may have a degree of privacy; and iv) VIP booths at the top, each surrounded by 6 foot high glass with open and closable fabric walls, each booth outfitted with chaises, couches, coffee tables, and other such furnishings. The VIP section may have a common bar area in the center (the center of the venue), and may have a common balcony surrounding and connecting all the VIP booths. Each aforementioned level of seating may be successively more private, spacious, luxuriously appointed, and expensive. All may have the ability to access and order food and beverages. The overall effect of the combined seating program may to meld the atmosphere of a club or lounge with the exhibition of a show and/or movie, creating a novel hybrid event.

III. Display Screens

FIG. 1 shows two example categories of screens that an exemplary venue may include theater screens (the torus-shaped interior structure 104) and secondary screens (robotic screens 114A and 114B). Different embodiments may include other types, layers, and numbers of screens. For example, some embodiments may include only a theater screen but no secondary screens. As another example, multiple theater screens may also be used throughout the single theater area, and come together as one image via a "raid". Other examples of display systems for both the front and rear screens may include: Front or rear projection, LEDs, laser projection, ASD LEDs, ASD front projection, holography, 3D "ghosting" or full 3D effect (e.g. Pepper's Ghost or a Steinmeyer illusion).

In addition to the torus-shaped interior structure 104 serving as a theater screen, secondary display screens such as 114A and 114B may also be included in an example theater area. In some embodiments, secondary screens may be smaller than theater screens and may be provided in front of the theater screen(s). Some secondary screens may be stationary. Other secondary screens may turn and move around a fixed support structure. Some of the secondary screens may be attached to 5 to 7 joint robotic arms. For example, a supporting arm for the secondary screens may include 180 degree to 360 degree pivoting features, allowing the screen some full motion. Some secondary screens may also be able to change position around the theater area, either freely across the entire theater area or in designated areas. Other secondary screens may be housed in quadrants or slices of the theater, for example, to come together in "raids" or function as separate screens. The support system of the secondary screens may attach to a sliding track that facilitates movement of one or more screens across the face of the theater wall or theater screen. The support system may or may not be mounted to the base of the movable performance stage 110. To produce such movements, servos and motors may also be included in the screen support or in the track system.

In some cases, the secondary screens may be controllable by automated or computerized control systems. For example, a screen may be supported on the end of a robotic arm so that the screen direction and position may be controlled as the arm is controlled. As another example, a secondary screen may be mounted on an automated conveyor so that the screen is movable along the length of the conveyor. A display that is movable through control circuitry and/or processors may be considered a robotic screen or a computer-driven screen.

Instead of, or in addition to, the secondary screens, a theater may include holographic, Steinmeyer illusion, and/or pepper's ghost apparatuses as a means of "image propagation" by which a live performer who is performing on a portion of the stage which is not presently in front of a given audience segment, may be seen virtually by that audience segment via holographic cannons or other 3D generating technology or devices.

Instead of, or in addition to, the secondary screens, and/or holographic, Steinmeyer illusion, and/or pepper's ghost apparatuses, a theater may include tertiary screens located in the audience area 108B, on the backside of the seat headrest (or directly above the headrest at eye level, in front of an audience member viewing it).

IV. Audio Systems

To facilitate using the entertainment venue, a variety of supporting systems may also be included. Some supporting systems are described herein with regard to features that are not used in a typical live-theater setting while others are not specifically mentioned by name or described herein. Other systems and structures may also support the entertainment venue; but those may be obvious to persons of skill in the art. In some embodiments, processing of both audio and video feeds and/or equipment may be run under the stage or audience.

Audio systems may be provided in an exemplary theater area. Audio input devices may be provided to support sounds associated with live performances. For example, musical acts may use input devices to capture voice and instrument sounds. As another example, stage acts may use microphones to capture on-stage voices and sound effects. Audio output devices may output these captured sounds and other audio associated with live performances or video displays.

Audio output devices, such as speakers, may be provided in any of various locations inside or outside of the theater area, and speakers may be existing or new technologies, or a mix of both for this specific venue. For example, speakers may be provided on or around the stage area, around the secondary display screens, and/or under and around the audience area. Moreover, in some cases, individual speaker systems may be provided within the audience seating area (e.g., chair-mounted speakers). In some embodiments, speakers may be provided behind or within the theater screen.

Stage Design and Architecture

I. Performance Stage

One or more performance stages may be provided in each of the venue's theater areas, as opposed to one continuous stage. As shown in FIG. 1, a performance stage may include a rotating ring-shaped stage encircling the audience area 110. The stage 110 may also be split in itself, where one-half of the stage (as in front and back) may rotate, where the other half may remain stationary, creating different visual effects, giving a separate platform to lay track for the independently moving secondary screens, and affording stage lifts the ability to operate under and through the stationary portion of the stage, while the moving portion of the stage is in motion. As another example, theaters which are not circularly symmetric may include stages that fit to the particular geometry of the room such as cubic or square shaped. In a theater area with more than one performance stage, the multiple stages may include various types of stages in addition to, or instead of, multiple instances of one type of stage.

In some embodiments, a movable performance stage may be used. For example, ring-shaped performance stage 110 may be designed to controllably rotate around the outside of theater area 106 or stand still. This movement may be uniform in speed or changeable. For example, stage 110 may either continuously move throughout the performance or stop periodically so that portions of stage 110 are directly in front of particular audience sections. The motion of the stage can be synchronized with the projected visuals so as to cause the audience to feel that it is they who are moving. The stage can also speed up or slow down, depending on need. In other embodiments, a performance stage may be designed to move vertically or into/away from the audience area, such as the front two thirds of the stage extending into the audience where the back third remains motionless.

The speed and pattern at which a performance stage moves may be chosen based on various factors. For instance, the typical speed and pattern may be dictated by industry standards, labor standards, technical considerations, and/or theater dimensions. Additionally, performance-specific movements may be chosen in accordance with, for example, audience preference, preference of performers, director choices, and/or audience arrangement. As an example of an audience-arrangement-based decision, when portions of the theater contain no audience, the movement pattern may be selected to avoid these portions.

II. Stage Supports

To support movement of a performance stage, moving stage supports may be provided beneath the stage. Mechanical supports may include, for instance, conveyors, rollers, conveyor belts, sliding elements, wheels, rollers, motors, gears, tracks, elevators, hydraulic systems, and maglev supports. The supports may be controllable by, for instance, manual controls, computer applications, remote controls, and/or stored control routines. For example, stored pre-created routines may include the movement patterns to use throughout a performance. In such an implementation, the stored routines may be executed at the start, middle or end of the performance to cause the stage to begin an intended movement pattern or spontaneous patterns throughout.

Other control mechanisms may also facilitate performance stage movement. In practice, safety controls may provide resources for slowing or stopping the motion of the stage in response to receiving alarm indications from sensors. For example, an audio or visual alarm may indicate that a performer or "setpiece" is off, or partially off, the stage. In response to detecting that something is moving or has moved on/off the stage, the controls may slow or stop the movement. In some cases, the controls may slow or stop the movement before a performer or prop goes over the edge of the stage. In particular, a controller may detect the distance between the object and the edge and slow stage movement in proportion to the detected distance. Likewise, sensors may detect the distance between the edge of the moving stage and objects/people on the stationary areas around the stage, to help prevent injuries.

To further prevent injuries, there may also be a protective raise that becomes active in response to determining that a performer is too close to the edge of the moving stage (or too close to an area of the stage that is not moving at the rate of the performer). This raise may follow the stage extensions if the stage moves forward and backward, as opposed to side-to-side. Furthermore, the movement controller may slow the stage in preparation for a stage entrance, exit, or collision. Such movement changes may also be determined by the proximity of the performer to the stage edge. As another example, an alarm may indicate that a microphone or speaker has moved to a position that is likely to cause audio feedback. As still another example, an alarm may indicate that a stage prop is blocking an emergency exit from the stage or safety equipment. In response to detecting that something or someone on the stage is not in a safe location, the movement controller may ensure that the stage moves to an orientation where the misplaced person or thing is better positioned.

In addition to safety sensors, sensing devices may also be used as stage cues to allow control systems to automatically detect when movement patterns should change, rather than relying on operators. For example, a performer who wishes to leave the stage during a performance and return to the stage later in the performance, may desire that the stage remains stationary until the performer returns. In this case, some of the movement of the stage may be pre-programmed and also controlled by a controller who may pre-program the stage to, first, stop stage movement in response to detecting the performer's egress and, second, resume stage movement in response to detecting the performer's return. As another example, the detected position of a particular prop or instrument may be used as an indication of how the stage should move. As still another example, a performer's on-stage movement may affect the stage movement. For instance, to facilitate a play that includes a scene in which a performer walks between two other scenes, a stage-control program may detect or receive indications of the performers walking speed and the time at which they begin walking In response, the stage may move to keep the performer in an active area of the stage, while they are walking Safety and other sensors may include various detection devices and processing components. For example, proximity sensors may indicate the position of a performer or setpiece on the stage and/or indicate that a performer has moved off the moving performance stage. Proximity sensors may also detect any person or thing that is extending over the edge of the stage. As another example, pressure sensors in the stage floor may indicate whether a performer is on or off the stage. Feedback sensing circuits or devices may indicate whether a speaker or microphone is in a bad acoustic location. Various other sensors may be used in an exemplary embodiment.

As mentioned earlier, some stages may include moving and non-moving portions. For example, the inside half of the stage (the portion of the stage that is closest to the audience) may rotate around the audience while the outside half of the stage remains stationary. In some implementations, the outside portion may not be movable at all. In other implementations, the outside may be separately movable from the inside portion. Other example stage support systems may involve various independently movable and/or non-movable portions to support complex stage-movement patterns.

Also mentioned earlier, the described systems and techniques for stage movement may be used alternatively for audience movement. In such an implementation, the movement of the audience with respect to a stationary (or independently moving) stage may be controlled in the various ways that are described above with respect to stage movement.

Modes of Use

Figure 2:
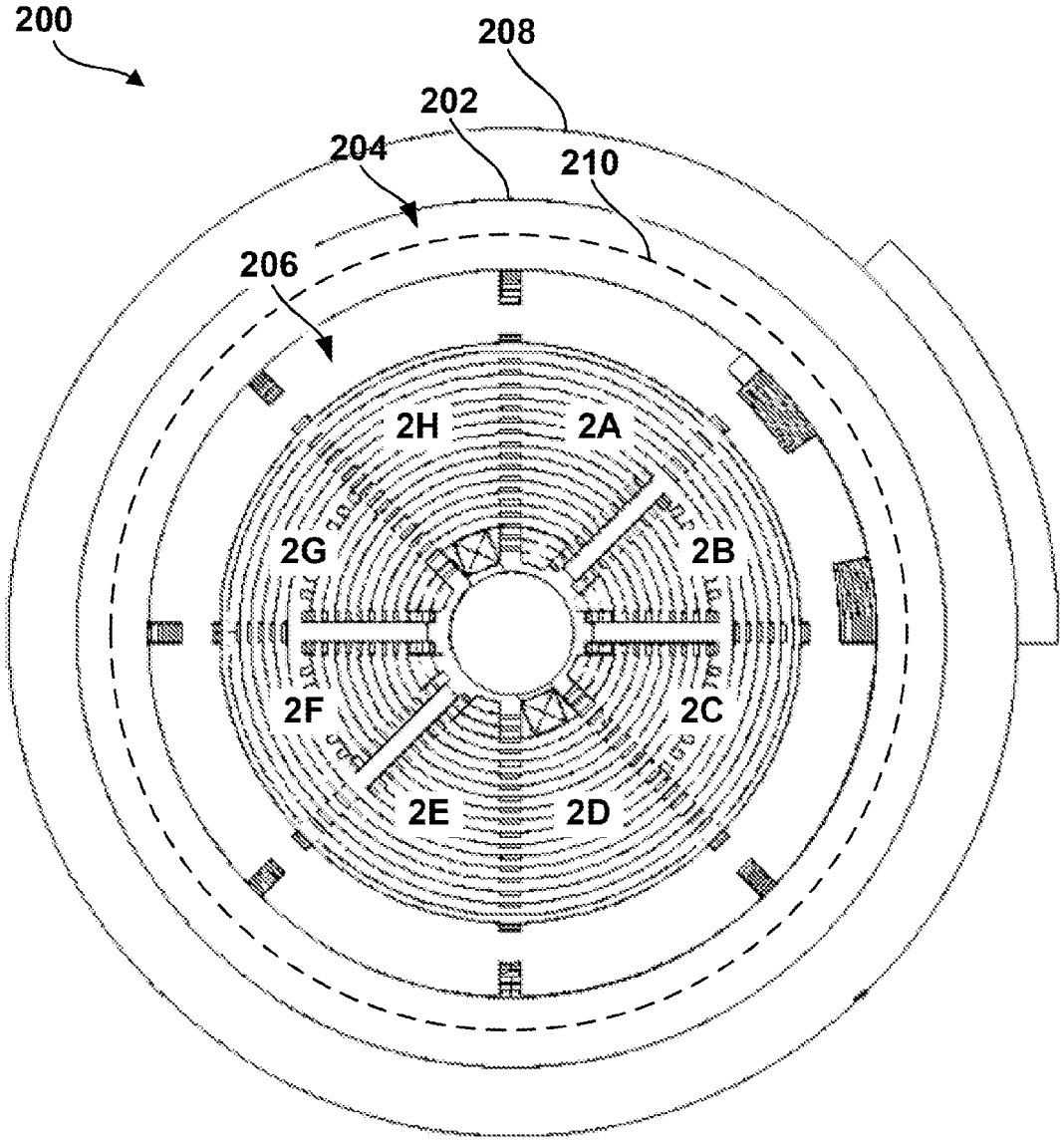
FIG. 2 illustrates elements of an example performance stage within an example theater as seen from above.

FIG. 2 shows an overhead view of an example toroidal theater 200, including a toroidal screen 202, a circular stage area 204, an external enclosure 208, and an audience area. The audience area contains a standing room area 206 directly in front of circular stage 204, and eight GA and VIP seating sections, labeled 2A-2H. Other embodiments may divide areas in other ways and may include additional seating, aisles, handicapped seating and other non-seating areas. Dotted line 210 divides stage area 206 roughly in half. In some embodiments, the two halves of stage 206 may move (or not move) independently of each other.

In some cases, a single theater area may be used simultaneously for multiple functions. In particular, some seating sections (such as sections 2A and 2D of FIG. 2) see substantially different portions of screen 202 and stage 204. Therefore, a different event could take place in each side of theater 200 without significantly detracting from either event. In some cases, temporary barriers may be erected or moved between the theater sections to visually and acoustically separate the sections. Temporary barriers or separations may include various features, such as soundproofing components (e.g., fiberglass sheets) and/or more or less display screens depending on the needs of the theater. The separation of a theater into two equal-sized sections is only exemplary; a theater may be divided into any number and size of sections for independent use.

I. Using a Rotating Performance Stage

As described above with respect to the design of stage supports, the movement of a performance stage may be controlled in a variety of ways. In addition to controlling the movement and positioning of a stage, the arrangement of performers, audience, and display systems may also require specialized techniques. For example, performers need not be placed directly together on the stage because different sections of the stage will be visible to different sections of the audience at any given time. As another example, the distribution of the audience may influence how the stage movement progresses. As yet another example, the motion of the stage may be synchronized with the projected moving images to compliment them and create a more convincing perception of motion, such that the audience feels that it is they (and not the projected images or stage) that are moving.

Figure 3:
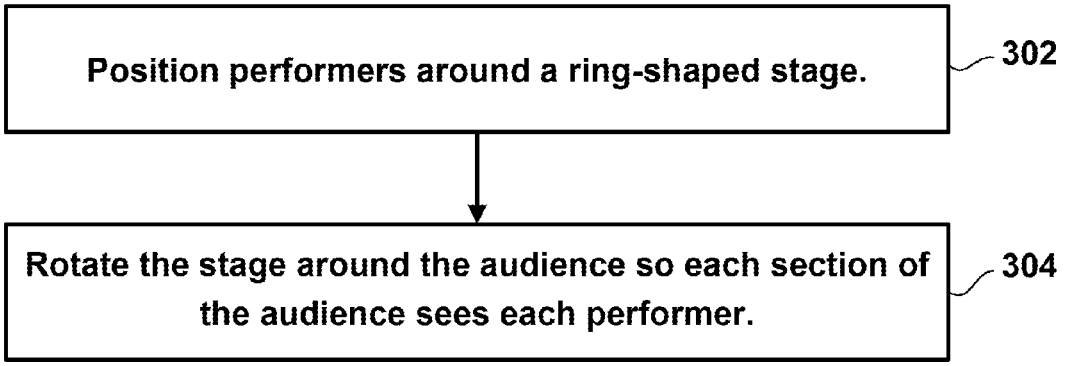
FIG. 3 shows steps of an example process for using the rotating stage.

FIG. 3 shows an example process 300 for use when multiple performers are to be spaced across the stage area. As shown, process 300 involves positioning the performers around the stage (block 302) and moving the stage so that all the audience sees each of the performers.

Figure 4:
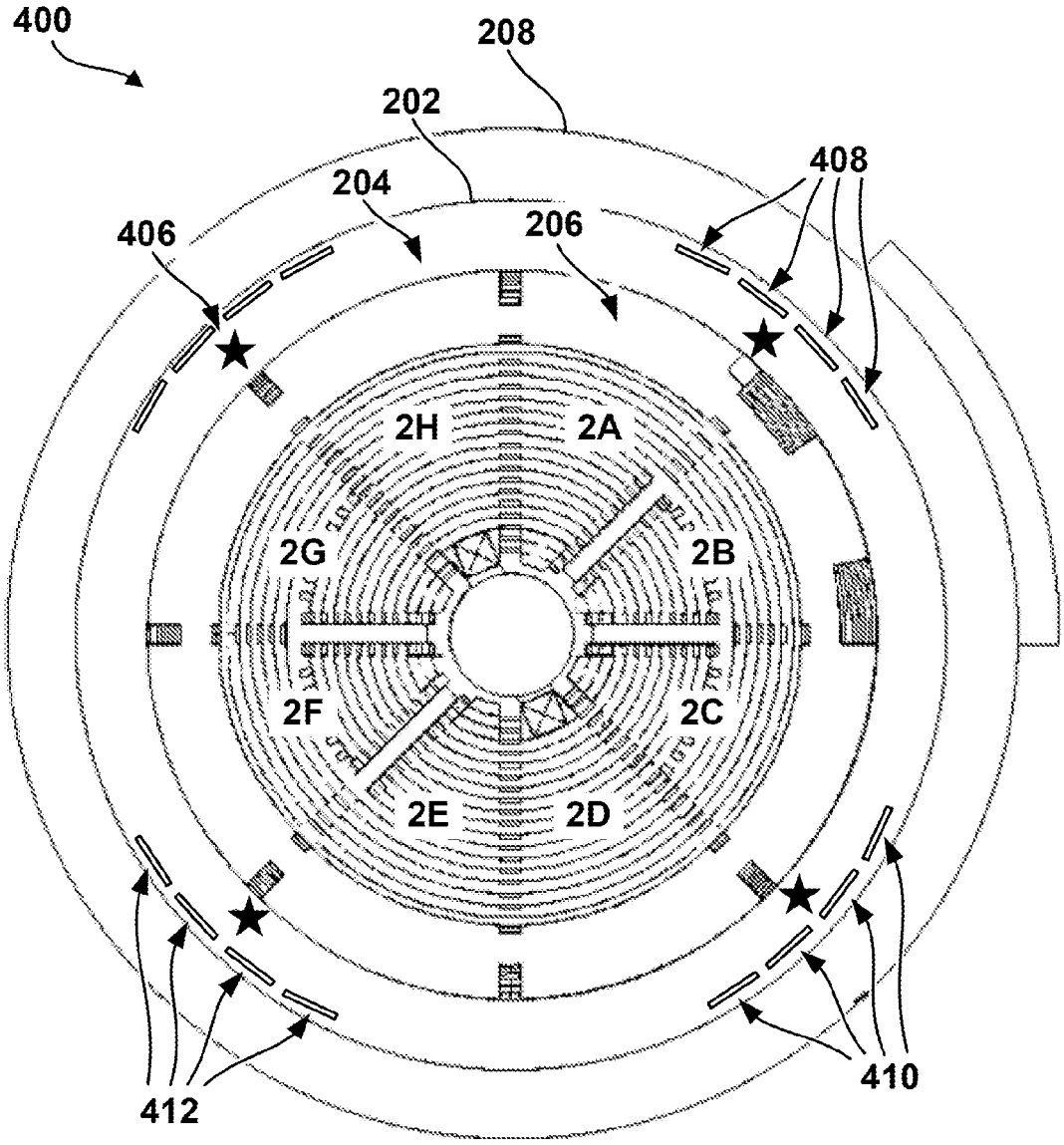
FIG. 4 is an example arrangement of performers (as "stars") and display screens around the stage in the theater area of FIG. 2.

In some cases, performers may be spaced evenly around the stage. For example, FIG. 4 shows an example arrangement 400 of four musicians (shown as stars, including star 406) of a band that is performing on circular stage 204 within toroidal screen 202. As shown, each of the members may be positioned at equal distances from one another to produce a square formation with each musician defining a vertex of the square. Any number of stage performers or features may be spaced evenly around a rotating stage or at random points. As the stage 204 rotates, different sections of the audience are able to see different performers. Such an arrangement minimizes the amount of time that a viewer cannot see any performer. In other arrangements, performers may be grouped in one or more groupings. Such an arrangement may allow performers to cooperate with one another.

Also shown in FIG. 4, clusters of secondary screens (e.g., clusters 408, 410, and 412) are included. Such secondary screens may rotate with the performers on the stage, so that the same set of screens are behind/beside the same performer throughout a performance or the screens may rotate or move in a pre-programmed pattern. In one embodiment, the secondary screens may be clustered together. In another embodiment, the secondary screens may not form clusters. Screens around or behind a performer may display images of the other performers on the other sections of the stage, so that an image of each performer is displayed in each group of screens. In other arrangements, the performer that is in front of a screen cluster may not be included in the images, so that all the performers are seen on any of the sides of the stage, but one of the performers is seen live at any time and the other performers are displayed on secondary screens (i.e., an image of performer 406 would appear on a screen from each of clusters 408, 410, and 412, but not on the screens behind star 406). In some cases, other display media (e.g., holographic or Steinmeyer illusion displays) may provide the "images" of the other band members. In this way, lifelike virtual band members may perform alongside one another and one real band member in four places around the stage, giving the impression that the full band is in front of four different audiences.

Although FIG. 4 shows four groupings of four secondary screens each, any number of clusters, containing any number of screens may be used. For example, four clusters of three screens may be used, or three clusters of six screens. In some cases, the position of the screens may be changeable. In this way, clusters of screens may be changed to group different numbers of screens in different ways, or the screens may be unclustered and spread out across the stage area.

Figure 5:
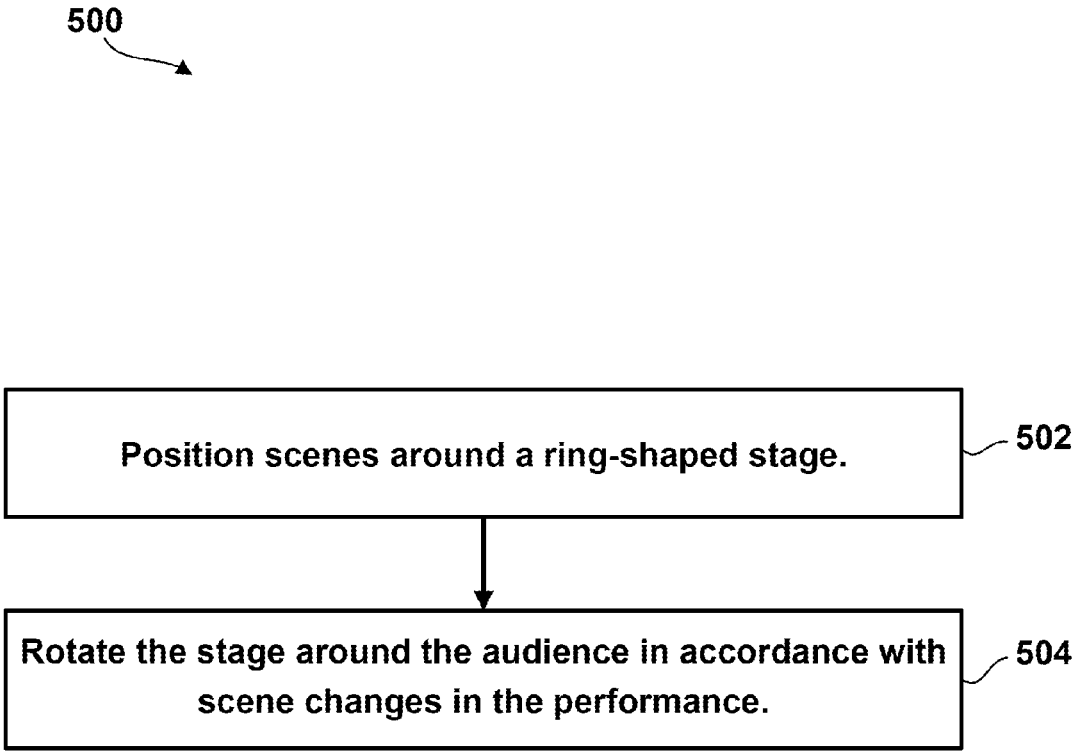
FIG. 5 shows steps of an example process for using the rotating stage.

Some performances that are not suitable to spacing apart performers (e.g., some plays and musicals, musical groups in which proximity is important, dialogs between performers, etc.), may take advantage of the unique stage shape by spacing scenes around the stage. FIG. 5 shows an example process 500 for using a rotating stage in a narrative performance. As shown, process 500 involves positioning performance scenes around the stage (block 502) and moving the stage in accordance with scene changes in the narrative (block 504).

The scenes may be placed around the stage in various ways. For example, the scenes may be grouped on one side of the stage. Such an arrangement may all the scenes to be visible to the audience, with one scene centrally located, indicating the focus of the action. As another example, if a play (or an act of a play) has four main scenes, then the setpieces and props for each scene may be placed at each of star locations. Among other advantages, this arrangement would allow a stage crew to set up all of the scenes before the performance, rather than changing sets during scene changes. Additionally, the narrative presented in a multiple-scene performance may be easier to understand when different scenes occupy different physical locations on the stage.

In some embodiments, the movement of the stage may be determined from the position of the audience. For example, an operator may input computer code that indicates that only sections 2A and 2B of the theater are occupied. In response, the system may implement a movement pattern that only presents a view of the live performers to sections 2A and 2B. In some cases, a portion of stage 204 may be visible to all of the audience members, without needing the stage to move at all. In that case, the stage movement may be used to assist in the movement of props/sets rather than moving performers. For example, prior to performance of a play, a crew may organize the set, props, and stage markers for each scene in the play in a different section of the moving stage. During the play, the crew can simply turn the stage until the right set is in the active portion of the stage rather than constructing and deconstructing each set during scene changes.

II. Combining Live and Recorded Entertainment

As described above, some theater areas may include live performance stages and live and/or pre-produced visual displays. For some events, the display screens or the performance stages may be used on their own. For example, movies may be shown on the theater screens without using any stages. Likewise, performance stages may be used for live acts without using the display screens. Other entertainment events may combine live performance and displayed images/video.

In some combined events, the screen images may include live video or images of the performers on the performance stage. For example, the screens may present images of the stage performers that are not visible to a section of the audience. In particular, while a performer is located at star 406 in FIG. 4, the system may determine that the performer is not visible to viewers in sections 2A-2F and, in response to the determination, the system may display video of the performer on portions of screen 202 that are visible to sections 2A-2F. Then, when the performer moves into view to the audience in sections 2A-2F, the system may detect this movement and responsively change the video of this performer to a video of a performer who is no longer visible in sections 2A-2F. In other arrangements, videos displayed on screen 202 may rotate in accordance with the movements of the stage. In this way, videos of each performer are presented to the audience while the performer is not in view. In still other arrangements, the system or a live director may select which videos to show based on criteria other than the movement of performers. For example, screen 202 may present videos of each performer at all times, regardless of the position of the performer. As another example, the system may switch between video feeds in accordance with preset timings or on-stage cues (e.g., detect guitar solo from a sound signal and responsively switch to video of guitarist.) This live performance footage can also be intercut in real time with prerecorded purpose-shot content (i.e., live and pre-produced content is shown simultaneously and/or separately at various intervals throughout the performance).

Figure 6:
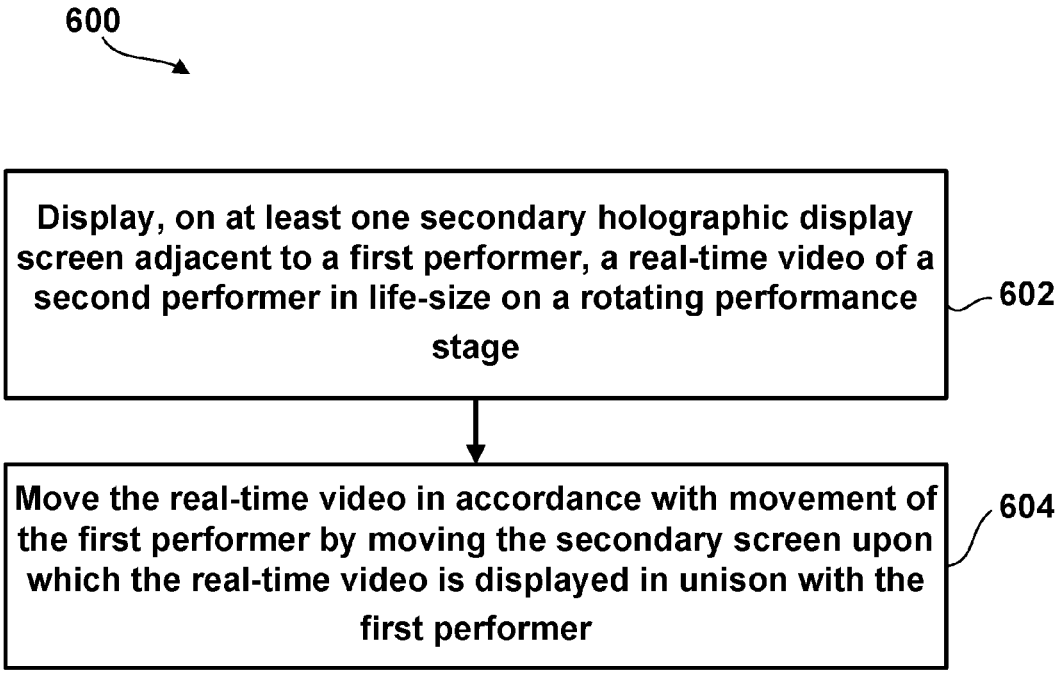
FIG. 6 shows steps of an example process for using the rotating stage.

For example, FIG. 6 shows steps of an example process 600 for using the rotating stage. In an operation 602, the system displays, on at least one secondary holographic display screen adjacent to a first performer, a real-time video of a second performer from a performance group in life-size on a rotating performance stage. In an operation 604, the system moves the real-time video in accordance with movement of the first performer by moving the secondary screen upon which the real-time video is displayed in unison with the first performer.

Figure 7:
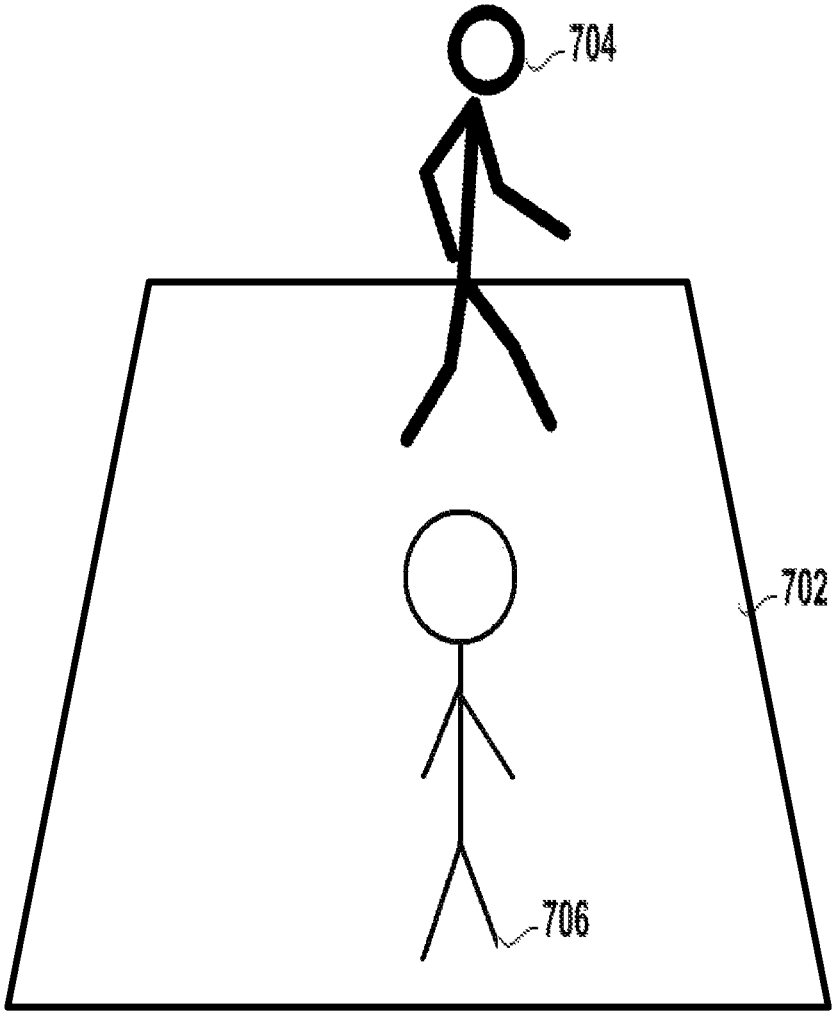
FIG. 7 illustrates elements of an example holographic display for displaying a performer on a performance stage.

FIG. 7 illustrates elements of an example holographic display for displaying a performer on a performance stage. In particular, FIG. 7 shows a secondary screen that includes a holographic display apparatus configured to display an image of a performer 706 in life-size at a position on a rotating performance stage 702, such that the performer 706 is adjacent to a second performer 704.

In some embodiments, action on the stage may affect or add to the displayed images. For example, images that are presented as a background for certain scenes in a performance may change when the scene of the performance changes. In other embodiments, on-stage actions may not directly affect or add to the displayed images. For example, screen 202 may present a background image or video simply as a backdrop for stage performers. As another example, the live performance may be designed to coincide with displayed images, but the images may be controlled independently of the on-stage action. One example of a designed coordination between live performance and video displays is a live-scored movie presentation, in which live performers provide the musical accompaniment to a movie presentation.

As yet another example, projected moving images can be combined with live action on stage to meld live performers with a virtual setting (i.e., certain movements (say, a fight sequence) can be choreographed. Camera moves can also be choreographed to capture performers rehearsing that sequence. The scene can then be filmed with the choreographed camera moves, but without the actors in frame. When the film is exhibited, live performers can then recreate the same choreography live on stage, and it should create the net effect of the live actor actually being present in the virtual environment.

CONCLUSION

The construction and arrangement of the elements of the systems and methods as shown in the exemplary embodiments are illustrative only. Although only a few embodiments of the present disclosure have been described in detail, those skilled in the art who review this disclosure will readily appreciate that many modifications or alterations are possible over the course of each construction (e.g., variations in sizes, dimensions, structures, shapes and proportions of the various elements, values of parameters, mounting arrangements, use of materials, orientations, etc.) especially when components are built to specifications, without materially departing from the novel teachings and advantages of the subject matter recited. For example, elements shown as integrally formed may be constructed of multiple parts or elements, with slight or major modifications but not modifications in overall principals or strategies. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner. Accordingly, all such modifications are intended to be included within the scope of the present disclosure. The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the overall design, operating conditions, and arrangement of the preferred and other exemplary embodiments without departing from the actual scope (or baseline ideas, thoughts, principals , etc.) of the present disclosure or from the scope of the appended claims.

Although the figures show a specific order of method steps, the order of the steps may differ from what is depicted, especially in the construction process of the various elements within. Also, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A method of using a performance stage that is moveable around an audience-area, the method comprising:

positioning a first performance stage area of the performance stage to be adjacent to a first section of the audience-area, wherein the performance stage is circular in shape;

positioning a second performance stage area of the performance stage that is different from the first performance stage area to be adjacent to a second section of the audience-area, wherein the first performance stage area and the second performance stage area are located on opposite ends of a diameter of the performance stage; and moving the performance stage in a substantially circular movement pattern around the audience-area, wherein:

the first performance stage area is moved from being adjacent to the first section of the audience area to being adjacent to the second section of the audience-area, such that the first performance stage area is not visible from the first section of the audience-area; and the second performance stage area is moved from being adjacent to the second section of the audience area to being adjacent to the first section of the audience-area, such that the second performance stage area is not visible from the second section of the audience-area, positioning a first performance element at the first performance stage area;

positioning a second performance element at the second performance stage area;

displaying on at least one secondary screen adjacent to the first performance element, a real-time video of the second performance element and synchronizing the real-time video being displayed with movement of the first performance element.

2. The method of claim 1, wherein synchronizing the real-time video with the movement of the first performance element comprises moving the secondary screen upon which the real-time video is displayed according to the movement of the first performance element.

3. The method of claim 1, wherein the secondary screen comprises a holographic display apparatus configured to display the second performance element on the performance stage, wherein an image of the second performance element displayed on the holographic display apparatus is substantially the same size as the second performance element.

4. The method of claim 1, wherein the audience-area comprises a plurality of audience seats surrounding a central point of the audience-area, wherein each of the plurality of audience seats is oriented to face away from the central point.

5. The method of claim 4, wherein the performance stage is circular around the central point and is located at a radius from the central point that is longer than a distance of any of the plurality of audiences seats from the central point.

6. The method of claim 4, wherein the audience seats comprise concentric rings of seats around the central point.

7. The method of claim 1, further comprising displaying the first performance element on the secondary screen in response to an indication to display the first performance element.

8. The method of claim 7, wherein the indication to display the first performance element comprises a preset timing indication.

9. The method of claim 7, wherein the indication to display the first performance element comprises detecting a sound signal from the first performance element.

* * * * *